US011713910B2

(12) United States Patent
DeCandia

(10) Patent No.: US 11,713,910 B2
(45) Date of Patent: Aug. 1, 2023

(54) ENVIRONMENTAL AIR CONDITIONING AND REFRIGERATION ISOLATION SAFETY VALVE

(71) Applicant: Sam DeCandia, Freehold, NJ (US)

(72) Inventor: Sam DeCandia, Freehold, NJ (US)

( * ) Notice: Subject to any disclaimer, the term of this patent is extended or adjusted under 35 U.S.C. 154(b) by 334 days.

(21) Appl. No.: 17/016,575

(22) Filed: Sep. 10, 2020

(65) Prior Publication Data

US 2021/0108839 A1 Apr. 15, 2021

Related U.S. Application Data

(60) Provisional application No. 62/913,099, filed on Oct. 9, 2019.

(51) Int. Cl.
*F25B 41/20* (2021.01)
*F25B 45/00* (2006.01)

(52) U.S. Cl.
CPC ..... *F25B 41/20* (2021.01); *F25B 45/00* (2013.01); *F25B 2500/221* (2013.01)

(58) Field of Classification Search
CPC ..... F25B 1/20; F25B 45/00; F25B 2500/221; F25B 41/24; F25B 41/22
See application file for complete search history.

(56) References Cited

U.S. PATENT DOCUMENTS

| | | | | |
|---|---|---|---|---|
| 4,321,797 | A | 3/1982 | Yaeger | |
| 5,172,557 | A | 12/1992 | Hubbell, Jr. | |
| 5,333,467 | A | 8/1994 | Pearl, II | |
| 5,901,946 | A * | 5/1999 | Lei-Jui | F16K 5/0668 251/315.15 |
| 5,915,402 | A * | 6/1999 | Mitchell, II | F25B 41/40 137/15.16 |
| 7,124,595 | B2 | 10/2006 | Park | |
| 7,516,942 | B2 | 4/2009 | Grau | |
| 2009/0013716 | A1 * | 1/2009 | Spearing | F25B 25/005 62/527 |
| 2013/0014525 | A1 | 1/2013 | Koge | |
| 2014/0251443 | A1 * | 9/2014 | Desrosiers | B08B 9/00 137/15.01 |

FOREIGN PATENT DOCUMENTS

CN 204828756 U * 12/2015

* cited by examiner

*Primary Examiner* — Kun Kai Ma
(74) *Attorney, Agent, or Firm* — Michael C. Balaguy

(57) ABSTRACT

A safety isolation valve module includes a conduit having a service port, an inlet, an outlet, and ball valves separating each of the inlet and the outlet from the conduit. The ball valves may be manually manipulating to open or close flow and can be used to isolate the service port from either or both sides of the refrigerant systems. When servicing the service port or other components of the refrigerant system, the valves may be shut to enable servicing of portions of the system without risking injury or losing significant amounts of refrigerant to the atmosphere.

6 Claims, 3 Drawing Sheets

ENVIRONMENTAL AIR CONDITIONING AND REFRIGERATION ISOLATION SAFETY VALVE

CROSS-REFERENCE TO RELATED APPLICATION(S)

The present application is related to and claims priority to U.S. Provisional Patent Application No. 62/913,099 filed Oct. 9, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of air conditioning systems of existing art and more specifically relates to refrigerant valves.

RELATED ART

Many air conditioning systems require the use of service ports to deplete or charge the system with refrigerant. When these service ports leak or malfunction, technicians are faced with challenges regarding how to safely decompress the system and replace the service port or service other parts of the refrigeration circuit. This process can be potentially dangerous as technicians risk "burning" themselves with highly cooled refrigerant escaping as components are disassembled. Further, with inefficient disassembly processes, much refrigerant can be lost from the system, adding to undesirable refrigerant pollution to the atmosphere. Most refrigerant systems lack the hardware to enable technicians to safely and efficiently isolate portions of the system during servicing.

In light of these disadvantages, a need is perceived for a mechanism enabling isolation of the service port and other portions of the refrigeration system to prevent injury to the servicing technician and minimizing loss of refrigerant to the atmosphere. Moreover, a need is also perceived for a retrofit system enabling the implementation of such a mechanism into existing air conditioning systems with no such provisions.

U.S. Pat. No. 5,172,557 to Paul J. Hubbell, Jr. relates to a bypass manifold valve for charging repairing and/or testing refrigerant systems. The described bypass manifold valve for charging repairing and/or testing refrigerant systems includes a device for servicing closed refrigerating systems comprising a double valve body with a transverse bore through a main shut off valve. The invention disclosed herein consist of methods for entering a closed refrigeration system for testing, charging and exiting the system, vacuum processes to vacuum the entire system and either the high or low sides of the system simultaneously and a method for the storage. The disclosed device and process eliminates a great percent of the loss of refrigerant in the refrigerant hoses when disconnecting during servicing and repairing the high side while using the recommended service techniques.

SUMMARY OF THE INVENTION

In view of the foregoing disadvantages inherent in the known refrigerant valve art, the present disclosure provides a novel inline safety isolation valve module for refrigeration systems. The general purpose of the present disclosure, which will be described subsequently in greater detail, is to provide an inline safety isolation valve module for refrigeration systems.

A safety isolation valve module includes a conduit having a service port, an inlet, an outlet, and ball valves separating each of the inlet and the outlet from the conduit. The ball valves may be manually manipulating to open or close flow and can be used to isolate the service port from either or both sides of the refrigerant systems. When servicing the service port or other components of the refrigerant system, the valves may be shut to enable servicing of portions of the system without risking injury or losing significant amounts of refrigerant to the atmosphere.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an inline safety isolation valve module for refrigeration systems, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a refrigerant valve module and more particularly to an inline safety isolation valve module for refrigeration systems as used to improve the safety of servicing refrigerant systems.

The present invention provides users with inline isolation valves used for allowing isolation of an air conditioning evaporator from a compressor and condenser while servicing the equipment. The valve system features two ball valves and a service port between the valves. Further, it includes a liquid line valve and a suction valve that allow for quick access to shut off the escape of refrigerant into the atmosphere while servicing air conditioner units. This functions as a safety system to prevent service technicians from being burned while trying to stop leaking service ports. It saves extensive amounts of time and effort by eliminating the need for refrigerant reclamation.

ACR Inline Isolation Valve is a diagnostic tool for air conditioning service technicians. The device is comprised of are inline isolation valves provided for allowing isolation of an air conditioning evaporator from a compressor and a condenser while servicing the air conditioning equipment.

The inline isolation valves consist of two ball valves with a service port located between the two valves. The invention may consist of a liquid line valve and a suction line valve. The inline isolation valves allow for quick access to shut off the escape of refrigerant into the atmosphere while servicing air conditioning. The inline isolation valves may be retrofit to air conditioning systems. Alternatively, the invention may be used by OEM of air conditioning systems and valve manufacturers.

The liquid line valve would be installed at the exit of the air conditioning condenser and the suction line valve at the line into the compressor. The invention allows the diagnosis and servicing of the components of the air conditioning systems without contaminating the entire system or having to reclaim the refrigerant from the entire system.

Referring now more specifically to the drawings by numerals of reference, there is shown in FIGS. 1-4, various views of an isolation valve module 100.

Figure 1:
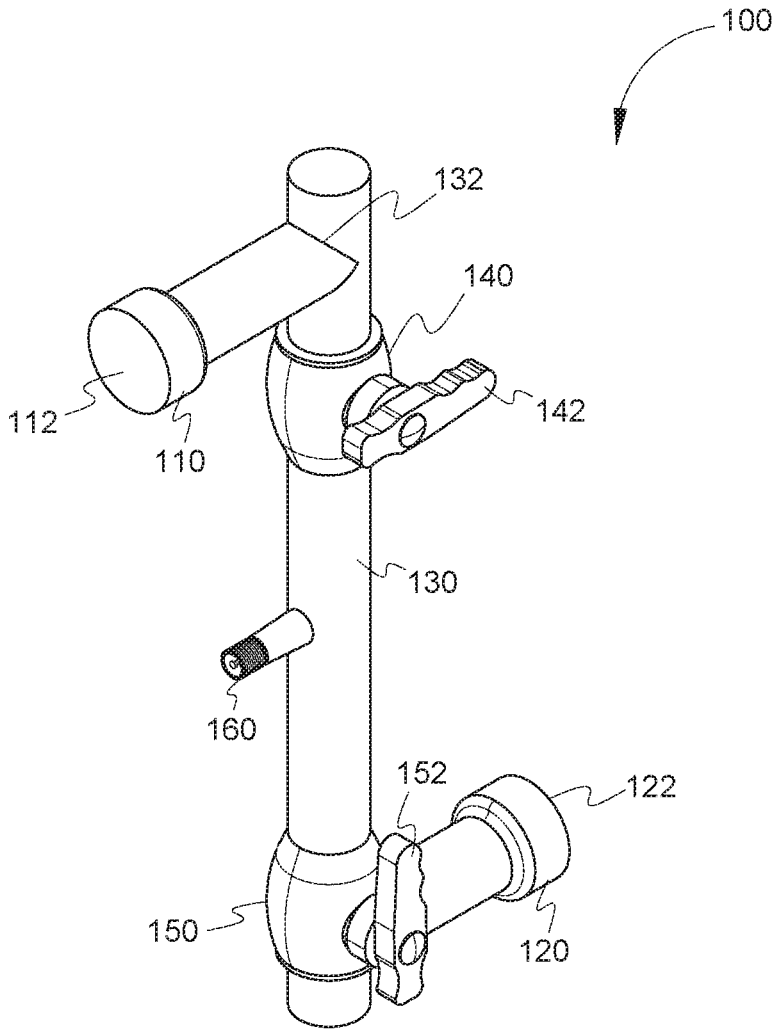
FIG. 1 is a perspective view of the isolation valve module having anon-inline geometry, according to an embodiment of the disclosure.

FIG. 1 shows an isolation valve module, according to an embodiment of the present disclosure. Here, the isolation valve module may be beneficial for use by a user to provide a refrigeration system with a service port having an isolation mechanism. As illustrated, isolation valve module 100 may include inlet 110 and outlet 120, each of which may be affixed to a conduit of an air conditioning circuit. Isolation valve module 100 further includes conduit 130 connecting inlet 110 to outlet 120, first-ball valve 140, and second-ball valve 150. First-ball valve 140 may join inlet 110 to conduit 130, such that first-ball valve 140 is able to selectively open or close fluid communication between inlet 110 and conduit 130. Likewise, second-ball valve 150 may join outlet 120 to conduit 130, such that second-ball valve 150 is able to selectively open or close fluid communication between outlet 120 and conduit 130. Schrader-valve 160 may be provided affixed to and in communication with conduit 130. First-ball valve 140 may include a valve stem terminating in first-handle 142 enabling a user to turn the ball within the valve. Likewise, second-ball valve 150 may include a valve stem terminating in second-handle 152. Inlet 110 may terminate in inlet-interface 112, and outlet 120 may terminate in outlet-interface 122. Each of inlet-interface 112 and outlet-interface 122 may be a flared opening for copper pipe, a barded fitting for liquid conduits, or other mechanical interfaces.

The illustrated embodiment further includes two elbows 132 disposed at first-ball valve 140 and second-ball valve 150 respectively. Preferably, elbow 132 disposes inlet 110 (or alternatively outlet 120) at about ninety degrees to conduit 130. This geometric arrangement is advantageous for providing isolation valve module 100 as a retrofit item to replace service port components of air conditioning systems that have similar geometric arrangements.

Figure 2:
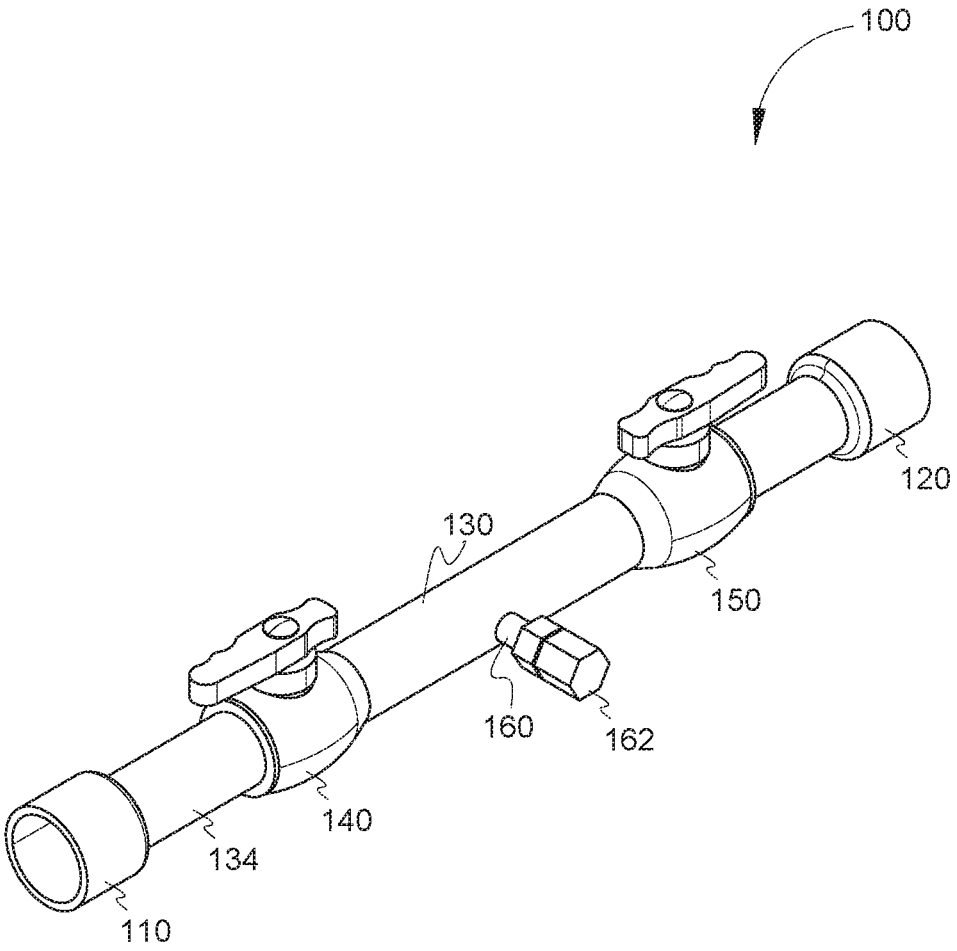
FIG. 2 is a perspective view of the isolation valve module of FIG. 1 having an inline geometry, according to an embodiment of the present disclosure.

FIG. 2 shows the isolation valve module of FIG. 1, according to an embodiment of the present disclosure. As above, the isolation valve module 100 may include inlet 110, outlet 120, conduit 130, first-ball valve 140, second-ball valve 150, and Schrader-valve 160. In the illustrated embodiment, inlet 110 and outlet 120 are connected to conduit 130 by straight-interface 134 such that all three components are inline with each other. This geometric arrangement may be most advantageous for efficient flow characteristics. Schrader-valve 160 may be threaded to accept cap 162.

Figure 3:
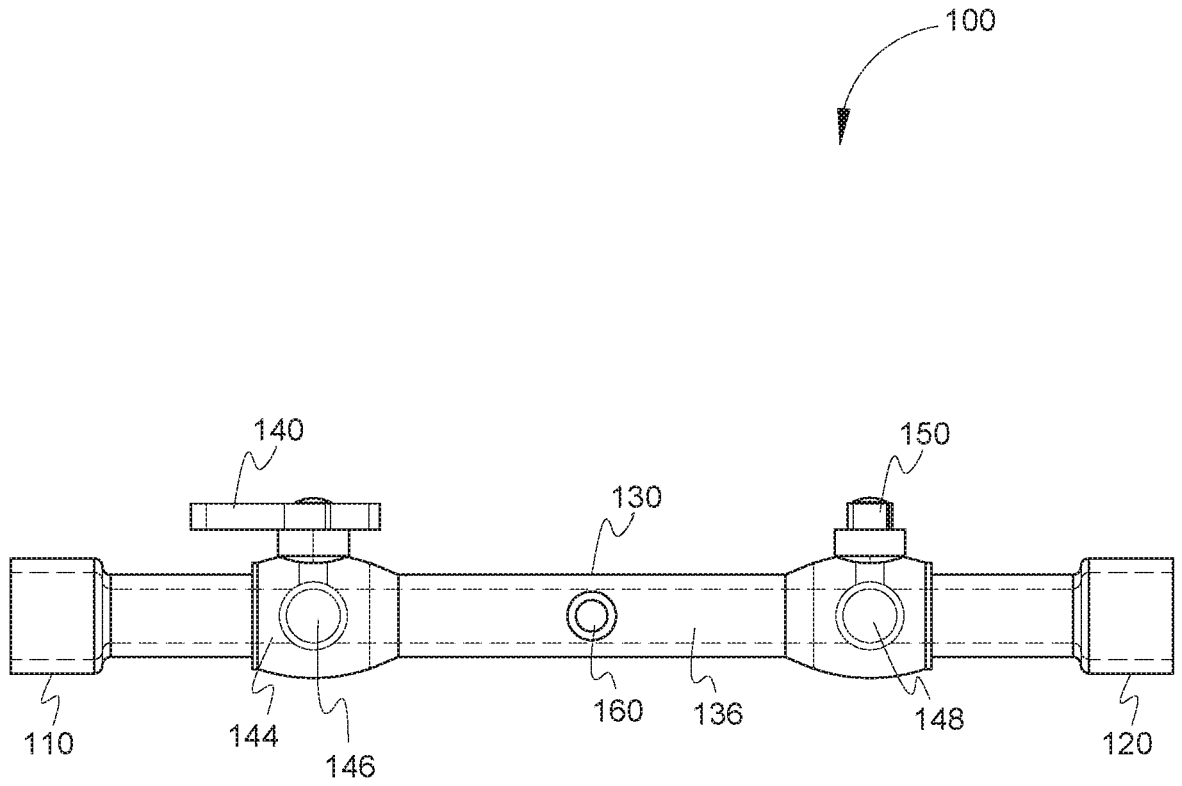
FIG. 3 is a cutaway view of the isolation valve module of FIG. 1, according to an embodiment of the present disclosure.

FIG. 3 is a cross-sectional view of the isolation valve module of FIG. 1, according to an embodiment of the present disclosure. As illustrated, conduit 130 includes bore 136 connecting first-ball valve 140 to second-ball valve 150. Schrader-valve 160 is in communication with bore 136, such that when Schrader-valve 160 is open, refrigerant (or other fluids) may pass into and out of bore 136. Each of first-ball valve 140 and second-ball valve 150 also include interior channel 144 and ball 146 interrupting interior channel 144. Ball 146 includes passage 148, which when aligned with interior channel 144, permits fluid passage through the valve. However, when ball 146 is turned, passage 148 no longer aligns with interior channel 144, and fluid passage is impeded. In the illustrated view, first-ball valve 140 is open, permitting fluid passage, and second-ball valve 150 is closed, impeding fluid passage.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An isolation valve module for refrigerant systems, the isolation valve module comprising:

an inlet, an outlet, a conduit connecting the inlet to the outlet, a first-ball valve joining the inlet to the conduit, the first-ball valve being able to selectively open or close fluid communication between the inlet and the conduit;

a second-ball valve joining the outlet to the conduit, the second-ball valve being able to selectively open or close fluid communication between the outlet and the conduit; and a Schrader-valve in fluid communication with the conduit;

wherein when both the first-ball valve and the second-ball valve are open, fluid can freely communicate between the inlet and the outlet;

wherein the inlet meets the conduit at a ninety degree angle;

wherein the outlet meets the conduit at a ninety degree angle; and wherein the inlet and outlet are parallel to each other, but each extend outwardly from the conduit at opposite directions to each other.

2. The isolation valve module of claim 1, wherein the inlet and the outlet are each affixed to the conduit at an angle between eighty-five and ninety-five degrees.

3. The isolation valve module of claim 1, wherein the inlet and the outlet are each affixed inline with the conduit.

4. The isolation valve module of claim 1, wherein each of the inlet and the outlet are flared.

5. The isolation valve module of claim 1, wherein each of the inlet and the outlet comprise compression fittings.

6. An isolation valve module for refrigerant systems, the isolation valve module comprising:

an inlet, an outlet, a conduit connecting the inlet to the outlet, a first-ball valve joining the inlet to the conduit, the first-ball valve being able to selectively open or close fluid communication between the inlet and the conduit, a second-ball valve joining the outlet to the conduit, the second-ball valve being able to selectively open or close fluid communication between the outlet and the conduit; and a Schrader-valve in fluid communication with the conduit;

wherein the inlet, the outlet, and the conduit together form a unitary component;

wherein when both the first-ball valve and the second-ball valve are open, fluid can freely communicate between the inlet and the outlet;

wherein the inlet meets the conduit at a ninety degree angle;

wherein the outlet meets the conduit at a ninety degree angle; and wherein the inlet and outlet are parallel to each other, but each extend outwardly from the conduit at opposite directions to each other.

* * * * *